US005713664A

United States Patent [19]

Harilela

[11] Patent Number: 5,713,664

[45] Date of Patent: Feb. 3, 1998

[54] BEVERAGE STIRRER WITH POP OUT ITEM

[75] Inventor: David Harilela, Kowloon, Hong Kong

[73] Assignee: Harilela (George) Ltd., Kowloon, Hong Kong

[21] Appl. No.: 747,867

[22] Filed: Nov. 13, 1996

[51] Int. Cl.[6] ..... B01F 13/00

[52] U.S. Cl. ..... 366/129; 40/406; 446/14; 446/199; D7/300.2

[58] Field of Search ..... 366/129, 130, 366/342, 343, 349; 239/33; 40/324, 406, 412; 446/14, 199; 215/387, 388, DIG. 8; D7/300.2; 220/703, 705, 706

[56] References Cited

U.S. PATENT DOCUMENTS

| | | | |
|---|---|---|---|
| 1,916,646 | 7/1933 | Tycko | D7/300.2 X |
| 1,916,988 | 7/1933 | Pieschke . | |
| 2,500,098 | 3/1950 | Soss | 40/406 X |
| 2,613,988 | 10/1952 | Jarbeau | 215/388 X |
| 2,717,463 | 9/1955 | Sindler | 40/324 |
| 2,815,981 | 12/1957 | Nonnamaker et al. | 215/DIG. 8 X |
| 3,099,565 | 7/1963 | Neuhauser | 215/388 X |
| 3,488,769 | 1/1970 | Falkenberg | D7/300.2 X |
| 3,776,458 | 12/1973 | Chunga, Sr. | 239/33 |
| 4,134,494 | 1/1979 | Wong | 215/388 X |
| 4,483,622 | 11/1984 | Muhi et al. | 366/343 X |
| 4,733,785 | 3/1988 | Turner, Jr. et al. | 239/33 X |
| 4,850,533 | 7/1989 | Hoshi et al. | 239/33 |
| 4,909,437 | 3/1990 | Kang | 239/33 |
| 5,021,019 | 6/1991 | Gandy . | |
| 5,253,779 | 10/1993 | Lee | 218/388 X |
| 5,329,714 | 7/1994 | Lee | 40/409 |
| 5,361,987 | 11/1994 | Matheussen et al. | 239/33 |
| 5,431,297 | 7/1995 | Rosello | 220/706 |
| 5,547,103 | 8/1996 | Murphy et al. | 215/388 X |

FOREIGN PATENT DOCUMENTS

| | | | |
|---|---|---|---|
| 2671332 | 7/1992 | France | 366/129 |

*Primary Examiner*—Charles E. Cooley
*Attorney, Agent, or Firm*—Stephen A. Gratton

[57] ABSTRACT

A beverage stirrer having a pop out item such as figurine, logo or product replica is provided. The stirrer includes a hollow, tubular casing with a sliding mechanism formed therein. The sliding mechanism can comprise a buoyant member actuated by fluid pressure from a beverage being stirred. Alternately, the sliding mechanism can comprise a temperature sensitive spring actuated by a temperature differential created by the beverage. The pop out item can be mounted to an end of the sliding mechanism and can be configured to extend out of an open end of the casing as the beverage is stirred. The stirrer can also include a handle/display member wherein indicia such as advertising or a logo can be printed.

28 Claims, 3 Drawing Sheets

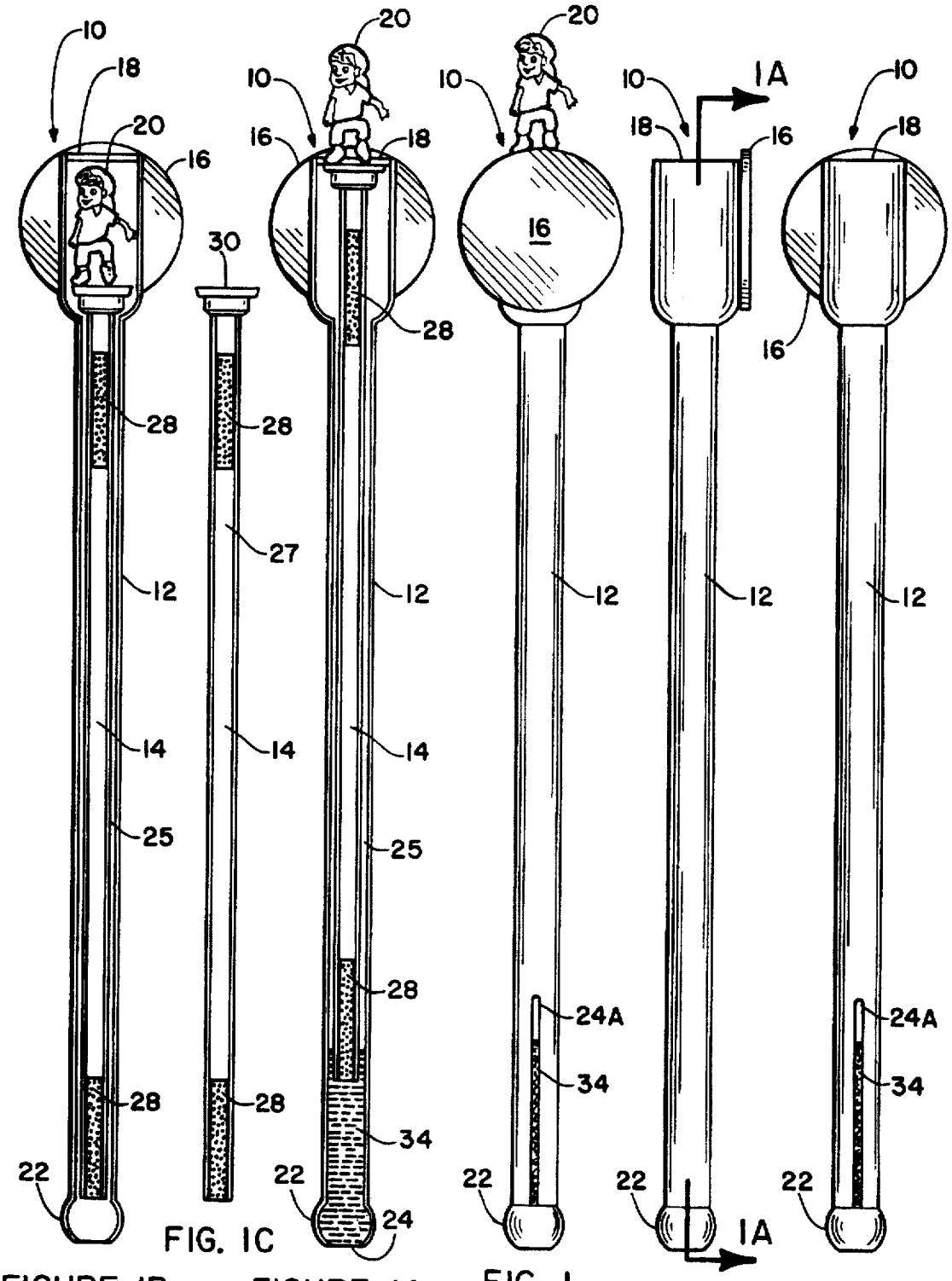
FIG. 1C
FIGURE 1B
FIGURE 1A
FIG. 1
FIG. 2
FIGURE 3
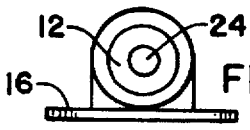
FIGURE 4
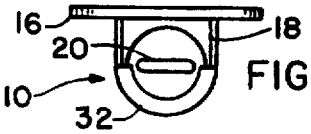
FIGURE 5

BEVERAGE STIRRER WITH POP OUT ITEM

FIELD OF THE INVENTION

This invention relates generally to stirrers for beverages and more particularly to a novelty beverage stirrer having a pop out item and to a method for fabricating the beverage stirrer.

BACKGROUND OF THE INVENTION

Some beverages, such as iced soft drinks and mixed drinks, can be served with a stirrer. Typically, these types of beverages are contained in a container, such as a cup or glass. Usually the stirrer is a cylindrical or rectangular shaped member adapted to be placed into the container with one end submerged in the beverage. The other end of the stirrer can be manipulated by a consumer to stir the beverage.

These stirrers not only perform a utilitarian purpose but in some cases perform an advertising function. For example, it has been common practice for manufacturers and business establishments to advertise their logo on some portion of the stirrer. Logos for alcoholic beverages and soft drinks are often placed on a handle portion of the stirrer.

In addition to advertising logos, there are stirrers that are constructed with a novelty feature. For example, miniature umbrellas are formed on the tip of some stirrers for serving some types of mixed drinks.

The present invention is directed to a stirrer that combines novelty, utilitarian and advertising features. Accordingly it is an object of the present invention to provide an improved beverage stirrer. It is a further object of the present invention to provide an improved method for fabricating a beverage stirrer. It is yet another object of the present invention to provide an improved method for stirring a beverage using a novel beverage stirrer.

SUMMARY OF THE INVENTION

In accordance with the present invention, an improved beverage stirrer, a method for fabricating the stirrer, and a method for stirring a beverage using the stirrer are provided. The stirrer, generally stated, comprises a hollow, open ended casing, and a sliding mechanism mounted within an interior portion of the casing. The sliding mechanism includes a pop out item configured to extend out of an open end of the casing as the beverage is stirred. The pop out item can be a novelty item such as a figurine, or can be advertising indicia, such as a logo or a product replica. The casing can also include a handle portion having a display surface wherein indicia such as advertising or a logo can be printed.

In an illustrative embodiment, the sliding mechanism includes a buoyant member actuated by fluid pressure from the beverage. In an alternate embodiment, the sliding mechanism includes a mechanical spring actuated by a temperature differential created by the beverage.

A method for fabricating a beverage stirrer in accordance with the invention comprises the broad steps of: forming a hollow open ended casing; slidably mounting a sliding mechanism within an interior portion of the casing; and forming a pop out item on the sliding mechanism configured to extend out of the casing as the beverage is stirred.

A method for stirring a beverage in accordance with the invention comprises the broad steps of: providing a beverage stirrer with a casing and a sliding mechanism having a pop out item; placing the stirrer in the beverage; and then actuating the sliding mechanism as the beverage is stirred.

BRIEF DESCRIPTION OF THE DRAWINGS

FIG. 1 is a front view of a beverage stirrer constructed in accordance with the invention;

FIG. 1A is a cross sectional view taken along section line 1A—1A of FIG. 2 illustrating the beverage stirrer and a sliding mechanism thereof, with the sliding mechanism shown in an actuated position;

FIG. 1B is a cross sectional view equivalent to FIG. 1A but with the sliding mechanism shown in an unactuated position;

FIG. 1C is a cross sectional view illustrating the sliding mechanism for the beverage stirrer separately;

FIG. 2 is a side elevation view of the beverage stirrer shown in FIG. 1 but with the sliding mechanism illustrated in an unactuated position;

FIG. 3 is a back view of the beverage stirrer shown in FIG. 1 with the sliding mechanism illustrated in an unactuated position;

FIG. 4 is a bottom view of the beverage stirrer shown in FIG. 1;

FIG. 5 is a top view of the beverage stirrer shown in FIG. 1;

DETAILED DESCRIPTION OF THE PREFERRED EMBODIMENTS

Figures 6, 6A, 7, 7A, 8, 9, 10:
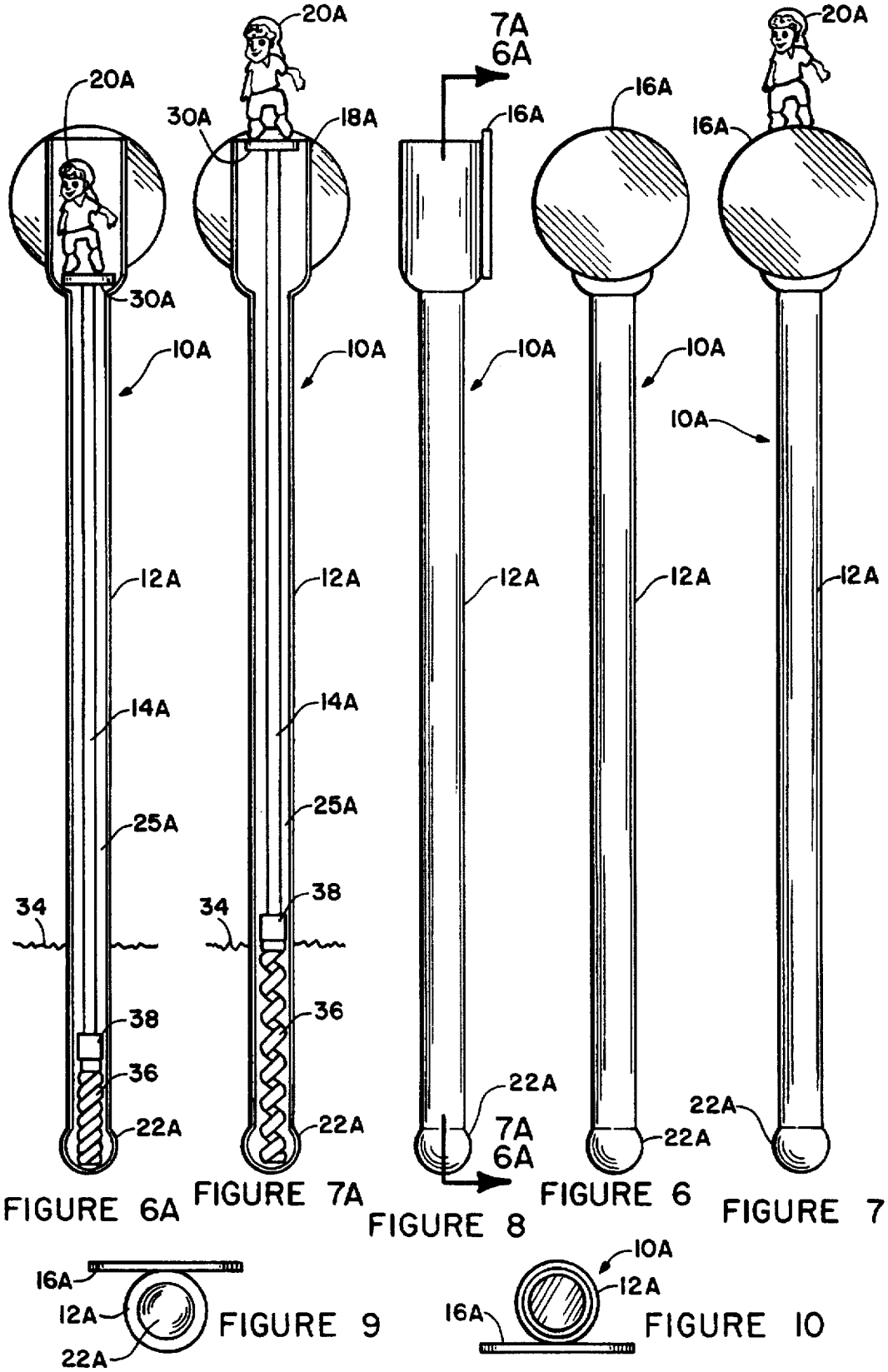
FIG. 6 is a front view of an alternate embodiment beverage stirrer illustrated with the sliding mechanism in an unactuated position.
FIG. 6A is a cross sectional view taken along section line 6A—6A of FIG. 8.
FIG. 7 is a front view of the alternate embodiment beverage stirrer illustrated with the sliding mechanism in an actuated position.
FIG. 7A is a cross sectional view taken along section line 7A—7A of FIG. 8.
FIG. 8 is a side elevation view of FIG. 6.
FIG. 9 is a bottom view of FIG. 6.
FIG. 10 is a top view of FIG. 6.

Referring to FIGS. 1–5, a stirrer 10 constructed in accordance with the invention is shown. The stirrer 10, broadly stated, includes a casing 12; a handle/display member 16 formed on the casing 12; a buoyant member 14 slidably mounted within an interior portion of the casing 12; and a pop out item 20 mounted to the buoyant member 14.

In the illustrative embodiment, the casing 12 comprises an elongated, hollow, generally cylindrical shaped tube having an inside diameter and an outside diameter. The casing 12 can be formed of plastic or other suitable material by injection molding or other suitable forming process. The casing 12 can be unitary in construction or can be formed in separate pieces attached to one another with adhesives or suitable fastener mechanisms. In addition, although the casing 12 is illustrated as being generally cylindrical in shape, it is understood that other shapes such as rectangular are also possible.

As clearly shown in FIG. 1A, the casing 12 can include an enlarged open end 18 which forms a chamber wherein the pop out item 20 can be retained. In the illustrative embodiments, the open end 18 of the casing 12 is formed with a larger inside diameter and a larger outside diameter than a remaining portion of the casing 12. However, it is to be understood that the open end 18 of the casing 12 can be formed with a same size as the remainder of the casing 12. In addition, the pop out item 20 can be configured to extend out of a different opening in the casing 12 than the open end 18.

As clearly shown in FIG. 1A, the handle/display member 16 is formed adjacent to the open end 18 of the casing 12. The handle/display member 16 functions as a handle for the stirrer 10 and as a display surface for printing indicia such as a logo or advertising. The handle/display member 16 can be formed integrally with the casing 12 or can be formed as a separate member attached to the casing 12 with an adhesive or other fastening mechanism.

Figure 11A:
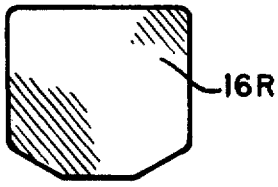
FIGS. 11A–11P are side elevation views illustrating various embodiments for the handle portion of the sliding mechanism.
Figure 11B:
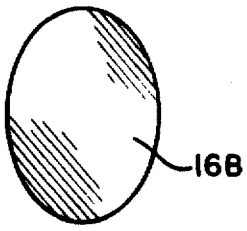
Figure 11C:
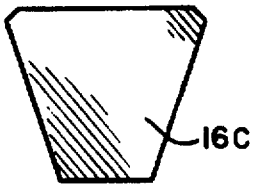
Figure 11D:
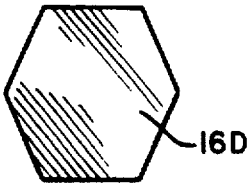
Figure 11E:
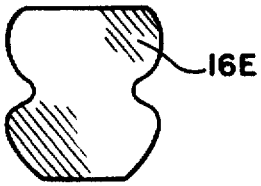
Figure 11F:
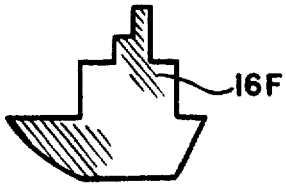
Figure 11G:
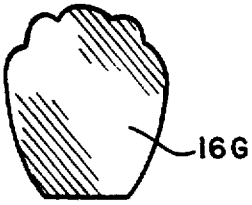
Figure 11H:
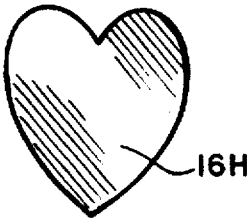
Figure 11I:
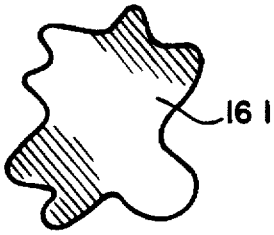
Figure 11J:
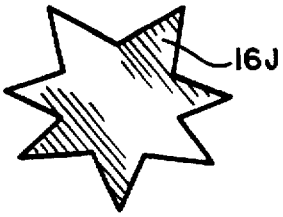
Figure 11K:
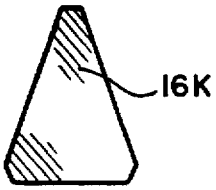
Figure 11L:
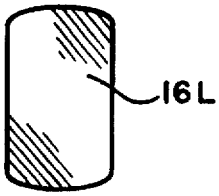
Figure 11M:
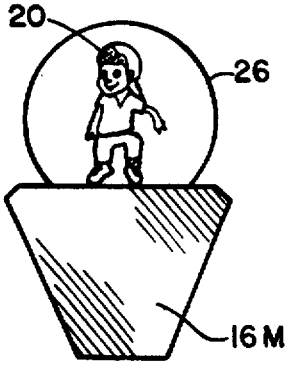
Figure 11N:
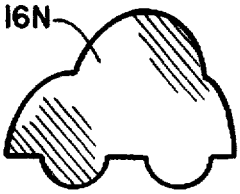
Figure 11O:
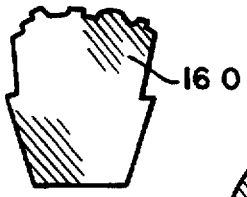
Figure 11P:
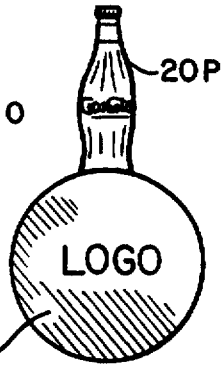

In the illustrative embodiment, the handle/display member 16 is circular in shape. Other exemplary shapes for the handle/display member 16 are shown in FIGS. 11A–11P. In FIG. 11A, a handle/display member 16R is generally rectangular in shape. In FIG. 11B, a handle/display member 16B is generally oval in shape. In FIG. 11C a handle/display member 16C is generally triangular in shape but with a flat tip. In FIG. 11D, a handle/display member 16B is generally pentagonal in shape. In FIG. 11E, a handle/display member 16E is in the shape of a vase. In FIG. 11F, a handle/display member 16F is in the shape of a boat. In FIG. 11G, a handle/display member 16G is in the shape of a flower. In FIG. 11H, a handle/display member 16H is in the shape of a heart. In FIG. 11I, a handle/display member 16I is in the shape of a puddle. In FIG. 11J, a handle/display member 16J is in the shape of a star. In FIG. 11K, a handle/display member 16K is in the shape of a triangle. In FIG. 11L, a handle/display member 16L is in the shape of an elongated rectangle. In FIG. 11M, a handle/display member 16M includes a transparent enclosure 26 that surrounds the pop-out item 20. The transparent enclosure 26 can be attached to the handle/display member 16M or to the buoyant member 12 if the open end 18 of the casing 12 is large enough. In FIG. 11N, a handle/display member 16N is shaped as a car. In FIG. 11O, a handle/display member 16O is shaped like a plaque. In FIG. 11P, a handle/display member 16P includes a logo that identifies a product. Also in FIG. 11P, the pop out item 10P is shaped as a product replica which in this case is a soft drink bottle.

Referring again to FIGS. 1–5, the casing 12 can include a bulbous tip portion 22 having a fluid inlet 24 (FIG. 4). The fluid inlet 24 is in flow communication with the hollow interior portion 25 (FIG. 1A) of the casing 12. The tip portion 22 can be formed integrally with the casing 12 or can be a separate member attached by interference fit or other mechanism. In addition, the casing 12 can include elongated fluid slots 24A (FIGS. 1 and 3) that function as fluid entry tunnels to the hollow interior portion 25 of the casing 12.

Referring to FIGS. 1A–1C, the buoyant member 14 is shown in detail. In the illustrative embodiment, the buoyant member 14 comprises a generally cylindrical shaped hollow tube formed with an inside diameter and an outside diameter. Such a buoyant member 14 can be formed of plastic or other suitable material sized to slide freely within the inside diameter of the casing 12. The buoyant member 14 can include one or more foam segments 28 packed into the inside diameter thereof. The foam segments 28 can be formed of foam or other buoyant material. Suitable plastic foams include polyurethane, polyethylene, and polystyrene. The space 27 (FIG. 1C) between the foam segment 28 can be filled with air to contribute additional buoyancy to the buoyant member 14.

The buoyant member 14 rather than being a hollow tube packed with foam can also be a solid piece formed of a buoyant material such as the foam materials previously described or other buoyant plastics. In this case the buoyant member can include a central longitudinal through opening to allow for pressure equalization.

The buoyant member 14 can include an enlarged pedestal portion 30 wherein the pop out item 20 can be mounted. The pop out item 20 can be formed integrally with the buoyant member 14 or can be formed separately and attached with an adhesive. In addition, the pop out item 20 can be a 3-D item or a flat two sided item formed in a desired shape.

In the illustrative embodiment, the pop out item 20 comprises a human figurine that is attached to the pedestal portion 30. As is apparent, the figurine illustrated is merely exemplary. Rather than being a human form, the figurine can also be an animal or a plant form. Besides figurines, the pop out item 20 can be a product replica as 20P in FIG. 11P, or merely a logo or other indicia. The pop out item 20 can also be a specialty item such as a sports action figure.

As clearly shown in FIG. 1B, the buoyant member 14 normally rests within the casing 12 with the pop out item 20 seated within the open end 18 within the interior portion 25 of the casing 12. However, as shown in FIG. 1A, when the stirrer 10 is placed into a container containing a fluid beverage 34, the beverage 34 can flow through fluid inlet 24 and fluid slots 24A and enter the interior portion 25 of the casing 12. Within the interior portion 25 of the casing 12, the beverage 34 raises to the level of the beverage in the container and surrounds the buoyant member 14. Fluid pressure acting on the buoyant member 14 and particularly on the foam segments 28 causes the buoyant member 14 to float upward in the casing 12 so that the pop out item 20 extends out of the open end 18 of the casing 12. This upward movement of the buoyant member can also be enhanced by fluid agitation caused by a user manipulating the stirrer 10. A lip 32 (FIG. 5) can be formed adjacent to the open end 18 of the casing 12 to retain the buoyant platform 14 within the casing 12.

Referring to FIGS. 6–9, an alternate embodiment stirrer 10A is shown. The stirrer 10A includes a casing 12A with an open end 18A, a hollow interior portion 25A, and a handle/display member 16A that function substantially as the equivalent components previously described. However, in this embodiment, the casing 16A includes a solid tip 22A. Preferably the solid tip 22A is formed of a metal and functions as a heat transfer surface between the interior portion 25A of the casing 12A and the fluid 34 being stirred.

As shown in FIGS. 6A and 7A, the sliding mechanism for stirrer 10A comprises a solid member 14A attached to a spring 36. Solid member 14A can be formed of a suitable material such as a hard plastic. In addition, the solid member 14A can include an enlarged pedestal portion 30A for the pop out item 20A. The spring 36 can be attached to the solid member 14A or can merely contact an end portion 38 of the solid member 14A. If desired, the end portion 38 can be formed with an indentation or other retention member for the spring 36. The spring 36 is constructed such that at room temperature the spring 36 is in a compressed position as shown in FIG. 6A. However, the spring 36 can be configured such that at a temperature less than room temperature, it will extend to the position shown in FIG. 7A. This temperature differential can be caused by the stirrer 10A being placed in a beverage 34 with a temperature less than room temperature. This type of temperature sensitive spring is readily commercially available. The expansion of the spring 36 causes the pop out item 20A to extend out of the open end 18A of the casing 12A substantially as previously described.

However, in this case actuation is mechanical rather than with fluid pressure.

Thus the invention provides an improved beverage stirrer in which a pop out item is configured to extend out of an open end of the stirrer as the beverage is stirred. Energy for moving the pop out item can be fluid pressure or mechanical. In addition, the stirrer can be used to provide an improved method for stirring a beverage wherein a pop out item serves a novelty or advertising function.

While the invention has been described with reference to certain preferred embodiments, as will be apparent to those skilled in the art, certain changes and modifications can be made without departing from the scope of the invention as defined by the following claims.

What is claimed is:

1. A beverage stirrer comprising:

a casing comprising an opening and a product logo;

a buoyant member slidably mounted within the casing for movement by a beverage entering an interior of the casing; and a pop out item attached to the buoyant member, said pop out item comprising a product replica configured to extend out of the opening as the beverage is stirred.

2. The stirrer as claimed in claim 1 wherein the product replica comprises a bottle.

3. The stirrer as claimed in claim 1 wherein the product replica comprises a soft drink bottle.

4. The stirrer as claimed in claim 1 wherein the buoyant member comprises foam.

5. The stirrer as claimed in claim 1 wherein the casing includes a handle portion.

6. A beverage stirrer comprising:

a hollow casing having an open end and a fluid inlet, said casing including a display surface comprising a product logo;

a buoyant member slidably mounted within the casing for movement by a beverage entering an interior of the casing; and a pop out item formed on the buoyant member, said pop out item configured to extend out of the open end of the casing as the beverage is stirred and the beverage contacts the buoyant member, said pop out item comprising a product replica.

7. The stirrer as claimed in claim 6 wherein the buoyant member comprises a foam material.

8. The stirrer as claimed in claim 6 wherein the display surface comprises a handle.

9. The stirrer as claimed in claim 6 wherein the pop-out item comprises a bottle.

10. A beverage stirrer comprising:

a hollow casing having an open end and a fluid inlet;

a buoyant member slidably mounted within the casing for movement by fluid pressurer, said buoyant member comprising a tube packed with a foam material;

a pop out item formed on the buoyant member configured to extend out of the open end of the casing as a beverage enters the casing; and a display surface formed on the casing.

11. The beverage stirrer as claimed in claim 10 further comprising indicia formed on the display surface.

12. The beverage stirrer as claimed in claim 10 wherein the display surface comprises a product logo.

13. The beverage stirrer as claimed in claim 10 wherein the casing includes at least one opening for fluid entry.

14. The stirrer as claimed in claim 10 wherein the pop-out item comprises an item selected from the class consisting of figurines, logos and product replicas.

15. A beverage stirrer comprising:

a hollow casing comprising an interior portion and a fluid inlet in flow communication with the interior portion of the casing, said casing further comprising a product logo;

a buoyant member slidably mounted within the interior portion of the casing configured for movement as a fluid enters the casing; and a pop out item formed on the buoyant member, said pop out item configured to rest substantially within the interior of the casing but to extend out of the casing as the fluid enters the casing, said pop out item comprising a product replica.

16. The stirrer as claimed in claim 15 wherein the product logo comprises a handle.

17. A beverage stirrer comprising:

a hollow casing comprising an interior portion and a fluid inlet in flow communication with the interior portion of the casing;

a buoyant member slidably mounted within the interior portion of the casing configured for movement as a fluid enters the casing;

a pod out item on the buoyant member, said pod out item configured to rest substantially within the interior of the casing but to extend out of the casing as the fluid enters the casing; and a transparent cover for enclosing the pop out item.

18. The stirrer as claimed in claim 17 wherein the buoyant member comprises foam.

19. The stirrer as claimed in claim 18 wherein the casing comprises molded plastic.

20. The stirrer as claimed in claim 18 wherein the pop out item comprises a product replica.

21. The stirrer as claimed in claim 18 wherein the pop out item comprises a soft drink bottle.

22. A beverage stirrer comprising:

a hollow casing comprising an open end and a tip portion configured for contact with the beverage;

a spring member mounted within the casing in a compressed position at room temperature but extendable within the casing to an extended position at a temperature less than room temperature;

a sliding member mounted within the casing in contact with the spring mechanism, said sliding member configured for movement by the spring member; and a pop out item on the sliding member, said pop out item configured to rest substantially within the casing but to extend out of the casing when the tip portion of the casing is placed in a beverage.

23. The stirrer as claimed in claim 22 wherein the casing includes a display member.

24. The stirrer as claimed in claim 22 further comprising a transparent cover for the pop out item.

25. A method for stirring a beverage comprising:

providing a stirrer comprising a casing with an open end and a fluid opening, said casing further comprising a product logo configured to form a handle, said stirrer further comprising a buoyant sliding member having a pop out item formed thereon, said pop out item comprising a product replica; and placing the stirrer in the beverage so that the beverage enters the casing and fluid pressure forces the buoyant member upward to move the pop out item out of the open end of the casing.

26. A method for forming a beverage stirrer comprising:

forming a hollow casing with an open end and a fluid inlet;

forming a handle on the casing, said handle comprising a product logo;

slidably mounting a buoyant member within the casing for movement by fluid pressure from a beverage; and forming a pop out item on the buoyant member such that the pop out item is disposed substantially within the casing but extends out of the casing as the beverage is stirred, said pop out item comprising a product replica.

27. The method as claimed in claim 26 wherein the product replica comprises a bottle.

28. The method as claimed in claim 26 wherein the product replica comprises a soft drink bottle.

* * * * *